United States Patent [19]

Riggs, Jr.

[11] Patent Number: 4,744,878

[45] Date of Patent: May 17, 1988

[54] ANODE MATERIAL FOR ELECTROLYTIC MANGANESE DIOXIDE CELL

[75] Inventor: Olen L. Riggs, Jr., Oklahoma City, Okla.

[73] Assignee: Kerr-McGee Chemical Corporation, Oklahoma City, Okla.

[21] Appl. No.: 931,993

[22] Filed: Nov. 18, 1986

[51] Int. Cl.[4] ..... C25B 11/04; C25C 1/00

[52] U.S. Cl. ..... 204/293; 204/105 M; 204/105 R

[58] Field of Search ..... 204/105 R, 293, 105 M

[56] References Cited

U.S. PATENT DOCUMENTS

| | | | |
|---|---|---|---|
| 3,957,600 | 5/1986 | Ives et al. | 204/105 |
| 4,080,278 | 3/1978 | Ravier et al. | 204/293 |
| 4,255,247 | 3/1981 | Oda et al. | 204/293 |
| 4,288,302 | 9/1981 | de Nora et al. | 204/293 |
| 4,295,942 | 10/1981 | Koziol et al. | 204/96 |
| 4,380,493 | 4/1983 | Wortley et al. | 204/105 |
| 4,460,450 | 7/1984 | Koziol et al. | 204/290 |
| 4,606,804 | 8/1986 | Schulke et al. | 204/286 |

OTHER PUBLICATIONS

Kirk-Othmer, *Encyclopedia of Chemical Technology*, vol. 20, 2nd ed. (1969) pp. 323, 324, 352-358, 369, 372-374.

*Anodic Protection*, Riggs and Locke, pp. 223 and 224, Plenum Publishing, 1981.

*Primary Examiner*—John F. Niebling

*Assistant Examiner*—Kathryn Rubino

*Attorney, Agent, or Firm*—William G. Addison; John P. Ward

[57] ABSTRACT

The present invention relates to titanium base alloy compositions having substantially improved resistance to corrosion in mineral acid environments and to structures fabricated therefrom. More particularly, the present invention relates to titanium base alloy compositions containing iron and copper in certain specified amounts, the remainder being substantially all titanium apart from incidental impurities therein and to anode structures fabricated therefrom for use in the electrolytic manufacture of battery grade manganese dioxide.

10 Claims, No Drawings

ANODE MATERIAL FOR ELECTROLYTIC MANGANESE DIOXIDE CELL

FIELD OF THE INVENTION

The present invention relates to titanium based alloy compositions characterized by their substantial resistance to corrosion in mineral acid environments. This invention further relates to structures fabricated from such titanium based alloys for use in said mineral acid environments. Particularly, this invention further relates to anode structures fabricated from such titanium based alloys, said structures being adapted for use in the electrolytic manufacture of battery grade manganese dioxide.

BACKGROUND OF THE INVENTION

Titanium, including the many known grades of commercially pure titanium and alloys of titanium (wherein titanium comprises the major constituent), possesses very desirable corrosion resistance in a wide variety of environments. For example, both commercially pure titaniums and alloys of titanium have demonstrated good corrosion resistance in such environments as air at temperatures up to about 650° C., in most aqueous salt solutions including chlorides, hypochlorites, sulfates, nitrates, and the like, and in many organic chemical environments including most organic acids (Kirk-Othmer, *Encyclopedia of Chemical Technology,* Vol. 20, pp. 369, et seq., 2nd ed. (1969)).

In general, the many grades of commercially pure titanium have better resistance to attack by strong chemicals than do the known alloys of titanium. However, commercially pure titanium has little resistance to corrosive attack by uninhibited, nonoxidizing mineral acids such as hydrochloric, sulfuric, nitric, and phosphoric acids, particularly at elevated temperatures. Although structures fabricated from commercially pure titanium can be employed in these mineral acid environments, if provided with a suitable protective coating usually comprised of a precious metal or oxide thereof, certain titanium alloys have been developed specifically for use in these environments. Typically, the alloys of titanium developed specifically for use in mineral acid environments have been those alloys containing a precious metal as the sole or primary alloying ingredient. Representative of such alloys of titanium are the Grades 7 and 11 specified in ASTM standard B348. In these ASTM grades, palladium is employed as the precious metal alloying ingredient to impart improved corrosion resistance to the titanium.

While various structures have been fabricated from the above described protectively coated commercially pure titanium and alloys of titanium and successfully used in applications where mineral acids were present, the use of such coated or alloyed titanium is not without disadvantages. With respect to both the protectively coated commercially pure titanium and the alloys of titanium, one disadvantage is the high cost of the precious metal material employed to form the coating or the alloy. Further, with regard to the use of protective coatings on commerccally pure titanium, there exists the added necessity of heat treatments at disadvantageously high temperatures to form the coatings and the poor adhesion of the coatings to the titanium.

Thus, a need exists for a titanium possessing good resistance to corrosion when exposed to mineral acid environments and which overcomes or avoids the disadvantages associated with the use of protectively coated, commercially pure titanium and the precious metal containing alloys of titanium. The present invention fulfills such needs.

SUMMARY OF THE INVENTION

The present invention relates to novel titanium base alloy compositions which are devoid of any precious metal alloying ingredients, but which are characterized by their substantial resistance to corrosion when exposed to a mineral acid environment at elevated temperatures. The novel titanium base alloy compositions of this invention comprise alloys consisting essentially of certain prescribed amounts of iron and copper with the balance of the alloy compositions being substantially all titanium apart from incidental impurities.

The present invention further relates to structures fabricated from these novel titanium base alloy compositions and particularly to anode structures for use in electrolysis processes wherein a mineral acid environment is present. More particularly, the present invention relates to anode structures, fabricated from the herein described novel titanium base alloy compositions, for use in the electrolytic manufacture of battery grade manganese dioxide. In said manufacture both solutions and vapors of byproduct mineral acids are produced.

DETAILED DESCRIPTION OF THE INVENTION

Acording to the present invention, novel titanium base alloy compositions are provided which are characterized by an improved resistance to corrosion in mineral acid environments. The improved resistance to corrosion of the titanium alloy compositions of this invention is substantial when compared to the corrosion characteristics of commercially pure titanium in the same acid environments. This is particularly true at elevated temperature such as those encountered in open-cell electrolysis processes employed in the commercial manufacture of battery grade manganese dioxide.

The novel titanium base alloy compositions of this invention comprise those alloy compositions wherein titanium constitutes a major constituent and iron and copper, in combination, constitute a minor or alloying constituent of these alloys. Particularly, the titanium base alloy compositions of this invention comprise those alloy compositions wherein the minor constituent consists of, in combination, from about 0.25 to about 1.5 weight percent of iron and from about 0.1 to about 1.5 weight percent of copper, said percentages being based on the weight of the alloy. The balance of the alloy compositions, i.e., the major constituent, is substantially all titanium apart from incidental inpurities that may be present therein. The term "incidental impurities" means an element present in the alloy compositions in small quantities inherent to the manufacturing process but not added intentionally. Representative examples of such elements include aluminum, manganese, mickel, cobalt, tin, and the like. Generally, no individual element constituting an incidental impurity will exceed an amount equal to about 0.1 weight percent and the total amount of any combination of these elements will not exceed about 0.4 weight percent. Preferably, none of these incidental impurities, and particularly aluminum, will exceed an amount greater than about 0.01 weight percent.

In addition to the iron and copper which, in combination, constitute the minor constituent of the alloy compositions of this invention and to the incidental impurities which also can be present, the alloy compositions described herein further can contain oxygen. Usually oxygen will be present in amounts ranging from about 0.15 to about 0.5 weight percent.

While the above described alloy compositions all possess improved resistance to corrosion in mineral acid environments, particularly effective alloy compositions of this invention are those wherein each of the iron and copper is present in a more narrow and preferred range of values. Thus, particularly preferred alloy compositions of the present invention are those consisting of from about 0.3 to about 1.2 weight percent of iron and from about 0.25 to about 1.2 weight percent of copper, the balance being substantially all titanium apart from oxygen and the incidental impurities in the amounts disclosed hereinabove.

The alloy compositions of this invention were developed only after conducting numerous experiments. From these experiments, the surprising observation was made that the more electrolytically active (i.e., the more negative the open circuit (no load) corrosion potential) a particular titanium sample became the less resistant said titanium sample was to corrosion in mineral acid environments. Experimentation with many different titanium compositions revealed that by varying the iron and copper contents in the titanium, an alloy composition could be produced with a more positive open circuit corrosion potential thereby rendering said composition more resistant to corrosion.

The manner in which the iron and copper, in the ranges discussed above, effect the corrosion potential and thus the corrosion resistance of titanium is not known. However, the result in nevertheless surprising. This is particularly true with respect to the use of increased amounts of iron in the compositions of this invention. For example, high purity titanium containing less than 0.05 weight percent of iron is sometimes specified for use in more aggressive environments such as mineral acids (Kirk-Othmer, *Encyclopedia of Chemical Technology,* Vol. 20, page 374, 2nd ed (1969)).

The alloy compositions of the present invention can be prepared by any of the known methods for preparing titanium metal and alloys thereof. Two widely employed methods involve the reduction of titanium tetrachloride with either magnesium (the Kroll method) or sodium in a closed system. Either method is suitable for manufacturing the titanium base alloy compositions of this invention, although neither forms any part of this invention. A general description of these methods, together with teachings of subsequent processing procedures, are set forth in Kirk-Othmer, supra, Vol. 20, pp 352–358, which teachings are incorporated herein by reference in their entirety.

The titanium base alloy compositions of the present invention can be employed as a construction material in a wide range of applications. However, these alloy compositions are especially suited for use as anode structures in electrolytic cells for the electrolytic manufacture of battery grade manganese dioxide.

In the electrolytic manufacture of battery grade manganese dioxide, a strong acid solution, e.g., sulfuric acid, is generated as a byproduct of the electrolysis reaction. The vapor space immediately adjacent to and above the surface of the electrolyte also is acidic as a result of the evaporation which occurs at this surface due to the high process temperatures, e.g., 95°–98° C., employed. Experience and observation have revealed that noncoated anodes fabricated from conventional commercially pure titanium compositions cannot readily withstand corrosive attack in this environment. Anodes fabricated from such titanium compositions tend to undergo catastrophic attack particularly at the interface between the surface of the electrolyte in the cell and the vapor space immediately adjacent to and above this surface. This situation is aggravated substantially where a paraffin oil or wax is applied to the surface of the electrolyte, as is common practice in the industry, to retain heat within the cell and to reduce electrolyte losses through evaporation. As the electrolysis reaction proceeds, the concentration of byproduct acid in this oil or wax layer increases and substantially is retained in this layer. Since the acid substantially is retained in this layer, and this layer is, in turn, in direct contact with the anodes, corrosion of the anode is accelerated. However, as noted hereinabove, the alloy compositions of this invention exhibit an enhanced resistance to corrosive attack by such acid solutions and vapors. Therefore, these alloy compositions and the anodes fabricated therefrom, represent a significant improvement over conventional commercially pure titanium and the anodes produced therefrom for use in the electrolytic manufacture of battery grade manganese dioxide.

The anodes of the present invention, fabricated from the above described titanium base alloy compositions, can include any of the known anode configurations proposed for or in use in the electrolytic manufacture of manganese dioxide. Thus, the anodes of the present invention can include any of the various bar, sheet, wire, or grid type anodes. Representative, but nonlimiting, examples of these types of anodes include those disclosed and described in U.S. Pat. Nos. 4,380,493; 4,606,084; 4,460,405; 3,957,600; and 4,295,942 and the teachings of which are incorporated herein by reference in their entireties.

The following examples are presented merely to illustrate the present invention. All parts and percentages are by weight unless otherwise specified.

EXAMPLES 1–10

Ten test coupons are prepared of various titanium base alloy compositions of the present invention. The compositional make-up of the particular alloy compositions employed for a given test coupon and the physical features of each coupon are set forth in Table I below.

TABLE I

| Sample | Alloy Composition Weight % | | Test Specimen | |
|---|---|---|---|---|
| No. | Fe | Cu | Dimensions, in. | Surface Area, in.$^2$ |
| 1 | 0.50 | 0.21 | 0.250 × 0.75 | 0.38 |
| 2 | 0.50 | 0.51 | 0.375 × 0.75 | 0.57 |
| 3 | 0.50 | 0.71 | 0.250 × 0.75 | 0.38 |
| 4 | 0.50 | 1.05 | 0.375 × 0.75 | 0.57 |
| 5 | 0.60 | 0.33 | 0.500 × 0.75 | 0.75 |
| 6 | 0.92 | 0.32 | 0.500 × 0.75 | 0.75 |
| 7 | 1.15 | 0.33 | 0.312 × 0.75 | 0.47 |
| 8 | 0.45 | 0.10 | 0.312 × 0.75 | 0.47 |
| 9 | 0.70 | 0.17 | 0.375 × 0.75 | 0.57 |
| 10 | 0.75 | 0.20 | 0.437 × 0.75 | 0.66 |
| A[a] | 0.26 | 0.001 | 0.375 × 0.75 | 0.57 |

TABLE I-continued

| Sample No. | Alloy Composition Weight % Fe | Cu | Test Specimen Dimensions, in. | Surface Area, in.$^2$ |
|---|---|---|---|---|
| B[b] | 0.23 | 0.001 | 0.375 × 0.75 | 0.57 |

[a]ASTM Grade 3 commercially pure titanium.
[b]ASTM Grade 2 commercially pure titanium.

To prepare these test coupons for electrochemical testing, each coupon is thoroughly conditioned and cleaned in the following manner. The coupons are first heated in a solution containing 37.3 grams/liter of $Mn^{2+}$ ions and 30.7 grams/liter of $H_2SO_4$ at a temperature of 95° C. for 24 hours. Following this heat treatment, each coupon is rinsed with a 3 percent by volume hydrogen fluoride solution for a period of about 1 minute and then with distilled water, scrubbed with a scouring powder and rinsed with hot (65° C.) distilled water and finally blown dry with nitrogen gas.

Following the above described conditioning and cleaning procedure, each of the test coupons is subjected to potentiodynamic testing. For this testing, each of the coupons is employed as an anode in a Princeton Applied Research corrosion test cell in which the electrolyte comprises a manganese sulfate/sulfuric acid solution. The electrolyte contains about 37.3 grams/liter of $Mn^{2+}$ ions and about 30.7 grams/liter of $H_2SO_4$. This electrolyte is maintained at a temperature of about 95° C. The cathode is graphite. The potentiometric scanning rate is 10 millivolts (mv) per second. Each test coupon is connected to a potentiostat for measurement of the open circuit corrosion potential of the coupon upon the application of a current thereto. The open circuit corrosion potential or anodic polarization curve then is recorded on a Hewlett-Packard X-Y plotter. Test coupons fabricated from ASTM Grade 2 and ASTM Grade 3 commercially pure titanium also are tested for comparative purposes. Results from the potentiodynamic testing of the coupons are set forth in Table II below.

TABLE II

| Test Coupon No. | Applied Current[a] ma | Current ma/in.$^2$ | Density ASF[b] | Corrosion Potential Emv oc vs SCE | Corrosion Rate, mpy[c] |
|---|---|---|---|---|---|
| 1 | 13 | 34.2 | 4.9 | +120 | 2.2 |
| 2 | 15 | 26.3 | 3.8 | +150 | 2.5 |
| 3 | 13 | 34.2 | 4.9 | +170 | 1.9 |
| 4 | 10 | 17.5 | 2.5 | +200 | 0.8 |
| 5 | 20 | 25.0 | 3.6 | +170 | 1.9 |
| 6 | 3 | 3.8 | 0.6 | +335 | 0.9 |
| 7 | 16 | 29.8 | 4.3 | +200 | 0.7 |
| 8 | 9 | 34.0 | 4.9 | +115 | 4.0 |
| 9 | 16 | 28.1 | 4.1 | +130 | 2.9 |
| 10 | 19 | 28.8 | 4.2 | +124 | 3.3 |
| A | 22 | 39.0 | 5.6 | −710 | 312.6 |
| B | 23 | 40.4 | 5.8 | −812 | 326.6 |

[a]At 1000 mv SCE.
[b]ASF = amps per square foot.
[c]Rate given in mils per year (mpy) and calculated employing the faradaic weight-loss equations appearing in Riggs and Locke, Anodic Protection, pp 223–224, Plenum Publishing (1981).

The above examples clearly demonstrate the efficacy of the alloy compositions of this invention. All of the test coupons fabricated from the various alloy compositions of the present invention exhibited positive open cell corrosion potentials and substantially reduced rates of corrosion. By contrast, the test coupons based on the Grade 2 and Grade 3 titanium compositions exhibited strongly negative open cell corrosion potentials and corresponding high corrosion rates.

While the present invention has been described with regard to what is believed to be the preferred embodiments thereof, it is to be understood that changes and modifications can be made without departing from the spirit and scope of the invention as defined in the following claims.

What is claimed is:

1. A titanium base alloy composition characterized by a positive open circuit corrosion potential and a substantially reduced rate of corrosion when contacted with a mineral acid environment, said alloy consisting essentially of from about 0.25 to about 1.5 weight percent of iron and from about 0.1 to about 1.5 weight percent of copper, said percentages based on the weight of the alloy composition, the balance of said alloy composition being substantially all titanium apart from incidental impurities.

2. The titanium base alloy composition of claim 1 further containing from about 0.15 to about 0.5 weight percent of oxygen based on the weight of the alloy composition.

3. The titanium base alloy composition of claim 1 wherein said incidental impurities can include aluminum in an amount less than about 0.01 weight percent based on the weight of the alloy composition.

4. The titanium base alloy composition of claim 1 wherein said iron ranges from about 0.3 to about 1.2 weight percent, and said copper ranges from about 0.25 to about 1.0 weight percent based on the weight of the alloy composition.

5. The titanium base alloy composition of claim 4 wherein said iron and said copper are present in said alloy in amounts of about 0.5 weight percent each based on the weight of the alloy composition.

6. An anode for use in an electrolysis process said anode comprising a titanium base alloy composition characterized by a positive open circuit corrosion potential and a substantially reduced rate of corrosion when contacted with a mineral acid environment, said alloy consisting essentially of from about 0.25 to about 1.5 weight percent of iron and from about 0.1 to about 1.5 weight percent of copper said percentages being based on the weight of the alloy composition, the balance of said alloy composition being substantially all titanium apart from incidental impurities.

7. The anode of claim 6 wherein the titanium base alloy composition of the anode further contains from about 0.15 to about 0.5 weight percent of oxygen based on the weight of the alloy composition.

8. The anode of claim 6 wherein the incidental impurities in the titanium base alloy composition of the anode can include aluminum in an amount less than about 0.01 weight percent based on the weight of the alloy composition.

9. The anode of claim 6 wherein the titanium base alloy composition of the anode consists essentially of from about 0.3 to about 1.2 weight percent of iron and from about 0.25 to about 1.2 weight percent of copper, based on the weight of the alloy composition, the balance of said alloy composition being substantially all titanium apart from incidental impurities.

10. The anode of claim 9 wherein the iron and copper in the titanium base alloy composition of the anode are present in said alloy composition in an amount of about 0.5 weight percent each based on the weight of the alloy composition.

* * * * *